US005197501A

United States Patent [19]

Ragatz

[11] Patent Number: 5,197,501

[45] Date of Patent: Mar. 30, 1993

[54] MULTI-PURPOSE CANE

[76] Inventor: Henry Ragatz, 2469 E. "F" St., Moscow, Id. 83843

[21] Appl. No.: 768,057

[22] Filed: Sep. 26, 1991

[51] Int. Cl.[5] ..... A45B 3/00

[52] U.S. Cl. ..... 135/66; 135/910; 135/76

[58] Field of Search ..... 135/66, 76, 77, 910, 135/911, 65

[56] References Cited

U.S. PATENT DOCUMENTS

| | | | |
|---|---|---|---|
| 1,595,023 | 8/1926 | Probe | 135/910 X |
| 2,597,172 | 5/1952 | Parker | 135/910 X |
| 2,642,519 | 6/1953 | Caustin et al. | 135/910 X |
| 3,251,371 | 5/1966 | Croker | 135/910 X |
| 3,275,815 | 9/1966 | Petroff et al. | 135/910 X |
| 3,281,586 | 10/1966 | Gonzalez | 135/910 X |
| 3,801,809 | 4/1974 | Slade | 135/910 X |
| 4,062,371 | 12/1977 | Bolen | 135/910 X |
| 4,236,544 | 12/1980 | Osaka | 135/910 X |

FOREIGN PATENT DOCUMENTS

| | | | |
|---|---|---|---|
| 0680199 | 6/1966 | Belgium | 135/910 |
| 2318989 | 10/1974 | Fed. Rep. of Germany | 135/910 |
| 2606046 | 8/1977 | Fed. Rep. of Germany | 135/910 |
| 2040676 | 1/1971 | France | 135/910 |
| 0216281 | 3/1942 | Switzerland | 135/910 |
| 0269832 | 4/1927 | United Kingdom | 135/910 |
| 2060370 | 5/1981 | United Kingdom | 135/910 |

*Primary Examiner*—David A. Scherbel
*Assistant Examiner*—Lan Mai
*Attorney, Agent, or Firm*—Terry M. Gernstein

[57] ABSTRACT

A multi-purpose cane includes a shaft portion that can be adjusted to different lengths, and an electrical circuit that is used to activate a light generating element and/or an alarm or communicating unit. The electrical circuit includes a manual switch mounted on a handle portion of the cane. A rechargeable battery unit is located in the handle portion, and a second light unit can be mounted on a tip of the cane so the can be used to direct light longitudinally of the shaft portion. The other light generating unit can be moved to direct light at various angles with respect to the shaft portion.

11 Claims, 6 Drawing Sheets

FIG. 2
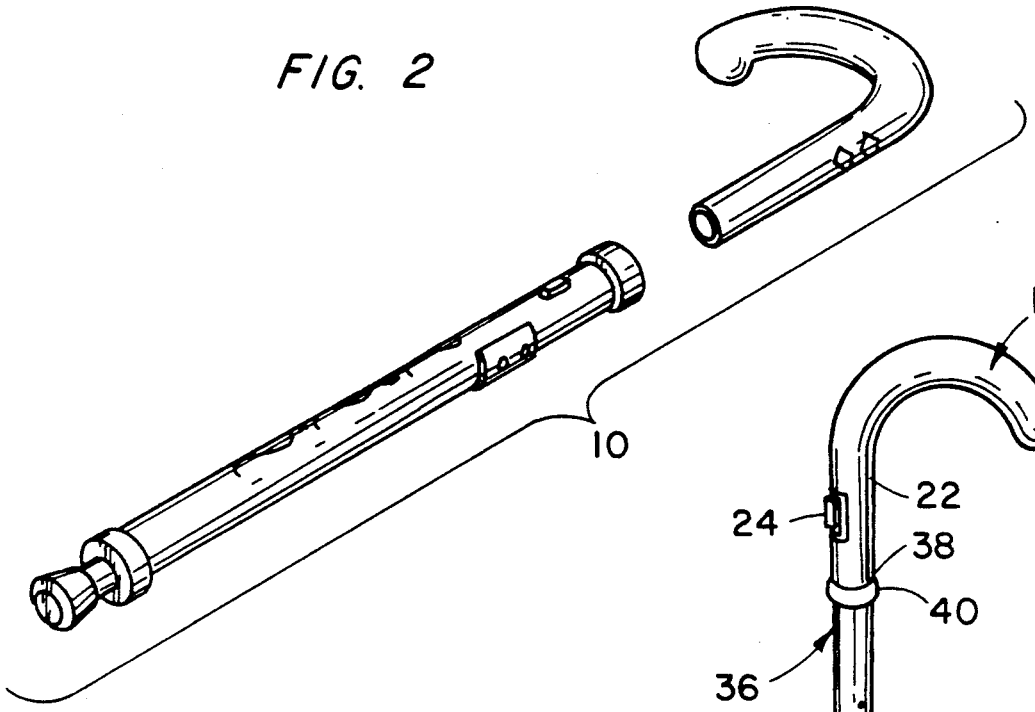
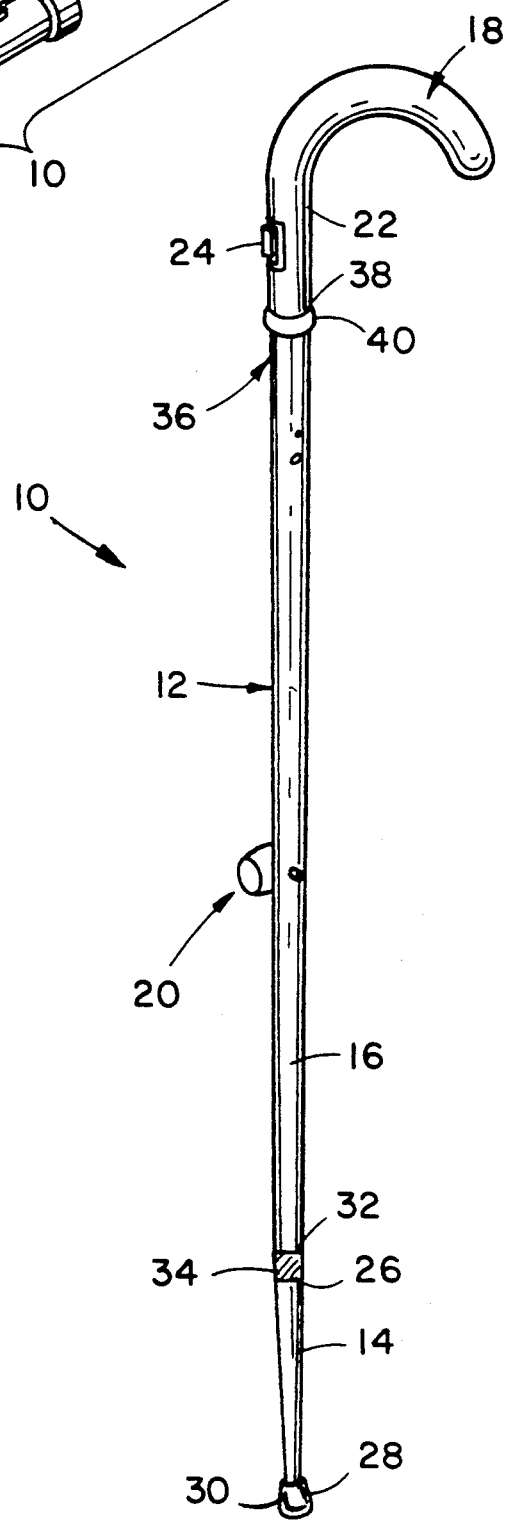
FIG. 1

MULTI-PURPOSE CANE

TECHNICAL FIELD OF THE INVENTION

The present invention relates to the general art of walking aids, and to the particular field of canes.

BACKGROUND OF THE INVENTION

Many people, especially elderly people, use some form of walking assistance to move about. A cane is the most common element used. Many of these people must move about at night and under a variety of conditions. For example, a person may use a cane at night while carrying other items. This person may also require constant monitoring due to medical conditions or the like. This additional requirement may add further equipment to the items that must be carried by the person. Such a situation may require the person to carry so many items with them that moving about is too much trouble and is simply foregone.

Therefore, there is a need for a cane that can be used at night. Specifically, there is a need for a cane that has a light generating system thereon.

However, each cane may be used in a variety of situations. Therefore, a single light generating means may not be suitable for all situations. For example, when a cane is required for actual step-by-step assistance in the dark, a light should be directed forward at about 45° with respect to the ground; a light fixed straight forward is virtually useless. When the cane is carried as a "walking stick," to have in hand if needed, the light should be directed along the longitudinal centerline of the cane so it can be directed straight down parallel to the cane if necessary, so the swinging cane becomes a regular flashlight being directed ahead and down as the cane is swung. If it is rotated through approximately 350°, from forward down and around to the rear, it can serve the above purposes and, in addition, be used to attract attention when walking in a roadway at night, either with or against traffic flow.

Therefore, there is a need for a cane having a light generating means thereon that can be adjusted to suit any particular situation.

Furthermore, many people have need for canes of a length that is different from other canes. This situation is caused by difference in walking styles, walking situations and even different heights. However, present canes are all generally manufactured to a fairly standard length. Therefore, some people actually need several canes, and some situations, such as nursing homes, there may be canes provided for general use. However, these general use canes may not be suitable for all uses due to the above-mentioned differences in situations. To accommodate such variations in requirements, many different canes should be available. However, this can be inefficient and expensive.

Therefore, there is a need for a cane that can be used in a variety of situations and can satisfy a variety of different requirements.

Still further, some people who use a cane may need assistance for one reason or another. Therefore, these people often carry special communicating and alarm means with them at all times. However, such means may not be easily accessible when needed and may also be cumbersome to carry, especially if the person is also using a cane.

Therefore, there is a further need for a cane which can be easily used by someone who also has other items to carry, such as communicating or alarm equipment.

OBJECTS OF THE INVENTION

It is a main object of the present invention to provide a walking cane.

It is another object of the present invention to provide a walking cane that can include a light generating system thereon.

It is another object of the present invention to provide a walking cane that can include a light generating system thereon which can be adjusted as suitable.

It is another object of the present invention to provide a walking cane that can include a communicating system thereon.

It is another object of the present invention to provide a walking cane that can include an alarm system thereon.

It is another object of the present invention to provide a walking cane that is adjustable to fit a variety of different situations and user needs.

SUMMARY OF THE INVENTION

These, and other, objects are achieved by a walking cane that includes a plurality of separate sections that can be adjusted with respect to each other, and which also includes an electrical circuit system. The cane also includes a light generating means thereon that can be adjusted to suit the needs of the user, and an alarm and communicating system that can be altered or used as required. The electrical system is battery operated, and the electrical system includes a jack means to which a battery charging circuit can be attached, as well as other accessories.

The cane is thus a multi-purpose cane and is amenable to a wide variety of uses and can be used by a variety of users each having different needs and requirements. However, since the cane is so adaptable, manufacturing costs can be kept to a minimum.

BRIEF DESCRIPTION OF THE DRAWING FIGURES

FIG. 1 is a perspective view of a multi-purpose cane embodying the present invention.

FIG. 2 is an exploded perspective view of the cane of the present invention.

DETAILED DESCRIPTION OF THE PREFERRED EMBODIMENT OF THE INVENTION

Figure 3:
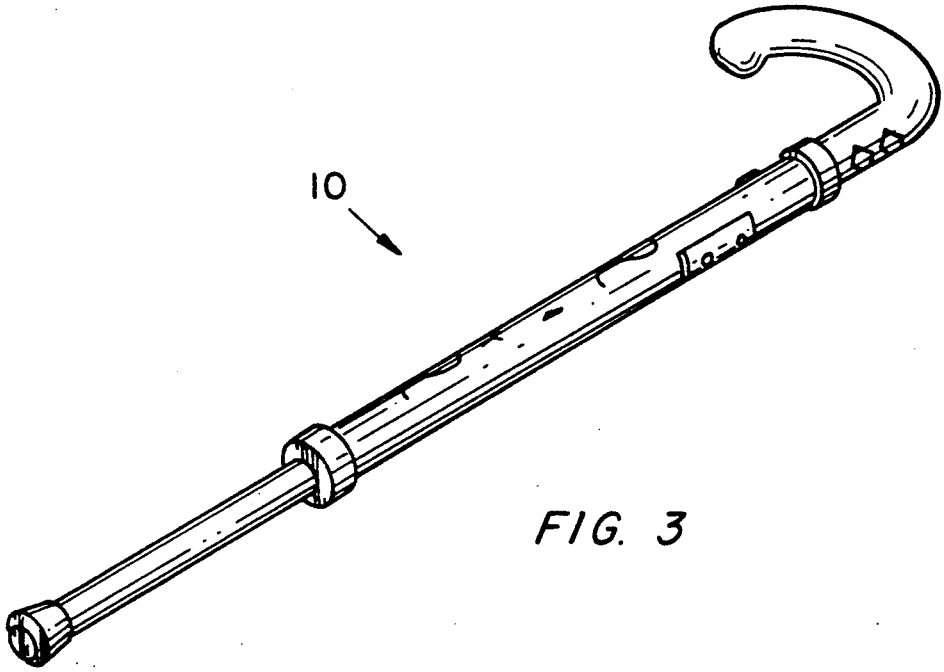
FIG. 3 is an assembled perspective view of a basic cane unit of the present invention.

Shown in FIGS. 1, 2 and 3 is a multi-purpose walking cane 10 embodying the present invention. The cane 10 includes a shaft portion 12 comprising a plurality of shaft sections, such as one section 14 and second section 16, and a handle portion 18 releasably connected to the shaft portion. A light generating unit 20 is mounted on the shaft portion, and is powered by a battery unit 22 located in the handle portion via an electrical circuit means and is operated by a manual switch element 24 mounted on the handle portion. Each of these various portions and elements will be discussed in greater detail below.

The shaft portion is adjustable for various heights. The shaft portion one section 14 includes a first end 26 and a second end 28, with a surface-engaging tip 30 on the second end 28. The one shaft section 14 is coupled to a second end 32 of the second shaft portion section 16 by a threaded connection that preferably includes a locking ring 34, but can also include mating threads on the two shaft portion sections In either case, the section 14 includes a screw thread located on the outside surface thereof. This exterior screw thread mates with an interior thread on the section 14 or in the locking ring. If the locking ring includes a screw thread, it also includes a shoulder portion that engages a flared end portion located on the second end 32 of the section 16.

The shaft portion second section 16 further includes an end 36 that is externally threaded. The externally threaded end 36 is releasably attached to the handle portion by an internally located screw thread either on the handle portion second end 38 or on a locking ring 40 in a manner similar to the just-described connection between section 14 and section 16.

The section 14 can be manufactured in various lengths and can be easily interchanged to accommodate people requiring canes of different heights. Also, by making the screw thread on the section 14 extend for a preselected distance along the length of the section 14, the height of the cane can be adjusted using the locking ring 34 by simply threading that locking ring onto the section 14 as far as desired.

Figure 8:
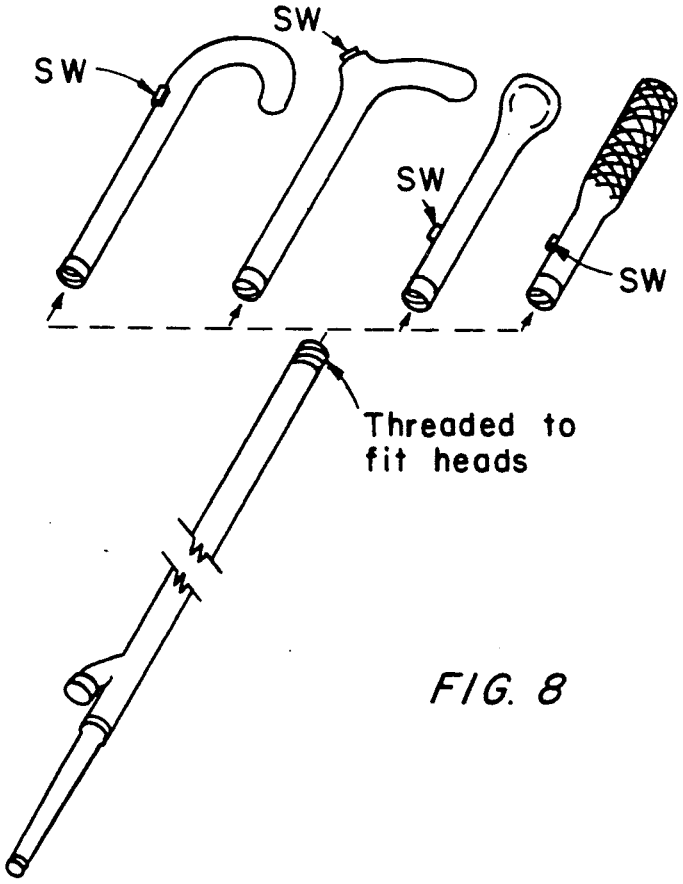
FIG. 8 is a perspective view showing various handle portions in combination with a basic shaft portion of the cane of the present invention.
Figure 10:
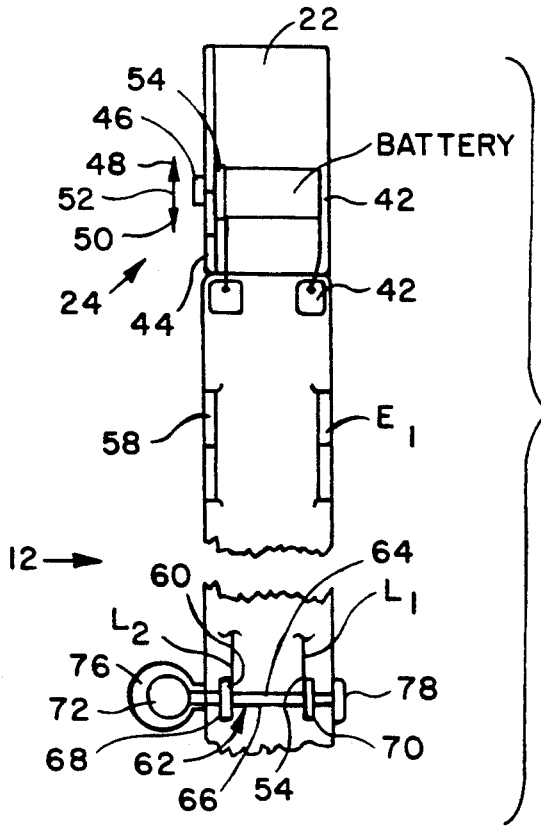
FIG. 10 illustrates an electrical circuit set up in the cane of the present invention.

The handle portion is hollow, and can include an arcuate shape shown in FIG. 1 or other shapes shown in FIG. 8. The hollow handle portion accommodates the battery unit 22 therein. Referring next to FIG. 10, it is seen that the handle portion also includes an electrical circuit This electrical circuit includes a first electrically conductive contact 42 mounted on the handle portion to electrically contact one side of the battery unit. The contact 42 extends out of the handle portion second end 38. The electrical circuit further includes a second electrically conductive contact 44 mounted on the handle portion and spaced from the first contact 42. The second contact 44 also extends out of the handle portion second end 38.

Figure 5:
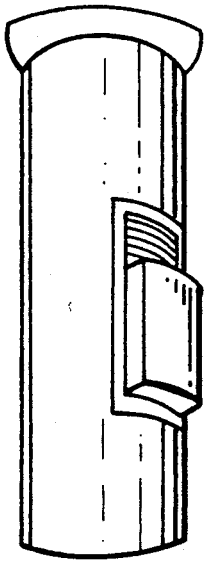
FIG. 5 is a perspective view of a switch element mounted on the cane handle portion.
Figure 4:
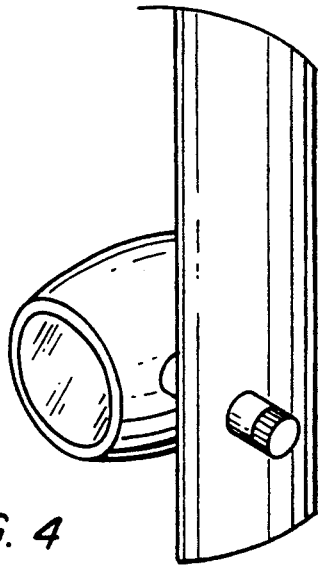
FIG. 4 is a perspective view of a light generating unit mounted on the cane.

As shown in FIGS. 1, 5 and 10, the handle circuit includes manual switch element 24. As is best shown in FIG. 10, the switch element includes a finger-contacting element 46 positioned outside of the handle portion in position to be operated by a user. The element 46 is mounted on the handle portion to move between an "off" position 48 and an "on" position 50 as is indicated by double-headed arrow 52. The switch element 24 further includes a first electrically conductive element 54 located to electrically contact a second side of the battery unit 24 and a second electrically conductive element 56 that is located to electrically contact the contact 44 when the switch is in the "on" position, and to be spaced from that contact 44 when the switch is in the "off" position. The battery unit includes rechargeable batteries and a recharging circuit element R as necessary.

The cane further includes a shaft portion electrical circuit for connecting the battery unit to the light generating unit 20 or to an alarm or communicating unit or to a recharging unit or any other accessory that may be used in conjunction with the cane 10. This shaft portion electrical circuit includes a first lead $L_1$ having one end $E_1$ mounted on the shaft portion section connected to the handle portion to be electrically contacted by the contact 42 when the handle portion is connected to the shaft portion. The lead $L_1$ extends along the shaft as indicated in FIG. 10 to a second end 54. The circuit further includes a second electrical lead $L_2$ having one end 58 thereof mounted on the shaft portion in position to be electrically contacted by the contact 44 when the handle portion is attached to the shaft portion. The second lead extend along the shaft portion and has a second end 60.

The light generating unit 20 includes a mounting shaft 62 rotatably mounted on the shaft portion and extending across that shaft portion. The shaft includes two electrical leads, 64 and 66 which are electrically insulated from each other. The lead 64 includes a first electrical contact ring 68 electrically connected to the lead 56 and the lead 66 includes a second electrical contact ring 70 electrically connected to the lead $L_1$. The two leads 64 and 66 are connected to a light generating element 72, such as a light bulb or the like, whereby power from the battery unit can be transferred to that element when the switch element 24 is in the "on" position. An electrically insulating case 76 encases the light generating element, and an electrically insulating knob 78 is mounted on the other end of the shaft 66. The knob is threadably mounted on the shaft, and the case is located on the shaft whereby the angle of the light generating element can be adjusted by unscrewing the knob, rotating the shaft about its longitudinal axis, and then tightening down the knob against the shaft portion. This tightening of the knob draws the case 76 against the shaft to lock the light generating unit into its set position. Lock washers can also be mounted on the knob and on the shaft in order to further set the desired position of the light generating unit.

Figure 6:
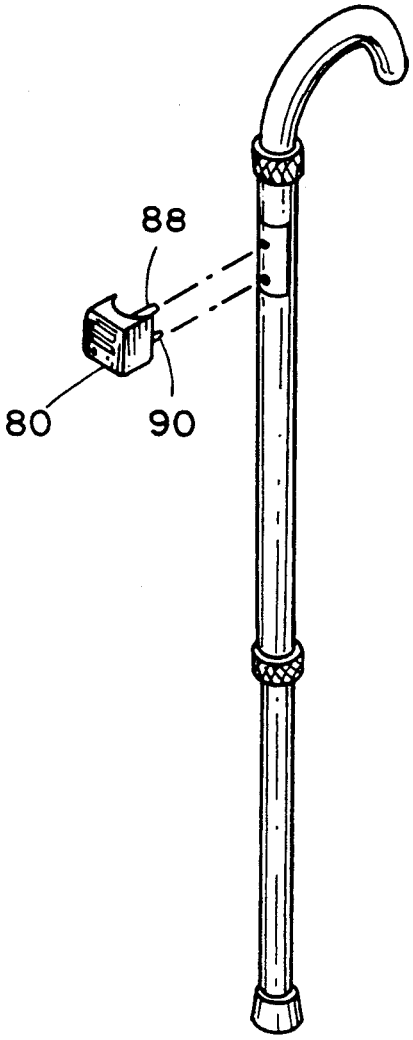
FIG. 6 is a perspective view showing a communicating unit in conjunction with the cane.
Figure 7:
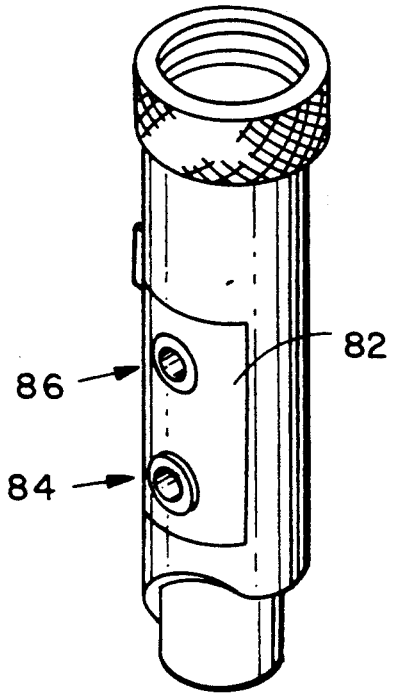
FIG. 7 is a perspective view showing a jack connection on the cane for use in connecting a communicating or alarm unit or a battery recharging unit to the cane.

As is shown in FIGS. 6 and 7, the cane can also include a communicating unit 80. The cane includes a jack unit 82 to which the communicating unit is releasably attached. The jack unit is attached to the electric circuit wires $L_1$ and $L_2$ via jacks 84 and 6 whereby the communicating unit is operated by the manual switch 24. The communicating unit can include an alarm or an over-the-air communication unit, such as an RF communicator that communicates with a monitoring station. The communicating unit includes two jack-engaging prongs 88 and 90.

Figure 9:
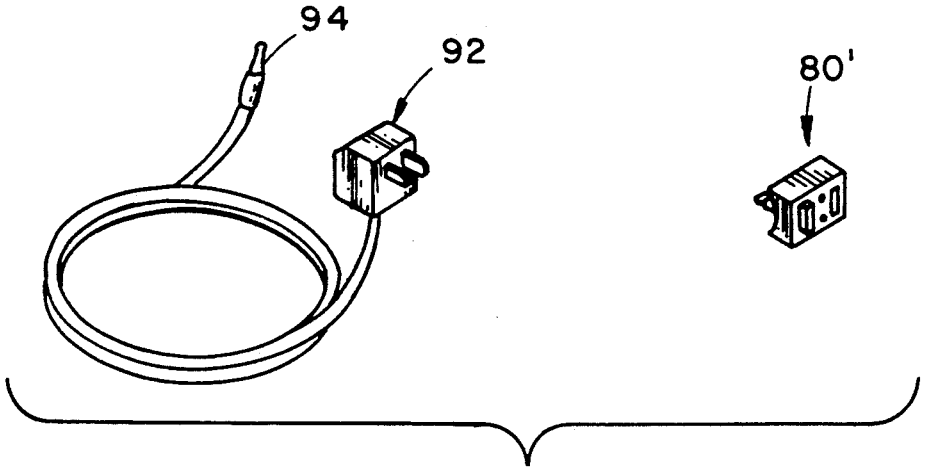
FIG. 9 is an exploded perspective view of an alarm or communicating unit that can be used in conjunction with the cane of the present invention.

A recharging unit 92 is illustrated in FIG. 9 in conjunction with an alarm unit 80'. The recharging unit 92 includes a jack-engaging prong 94 that is attached to the unit 82.

Figure 11:
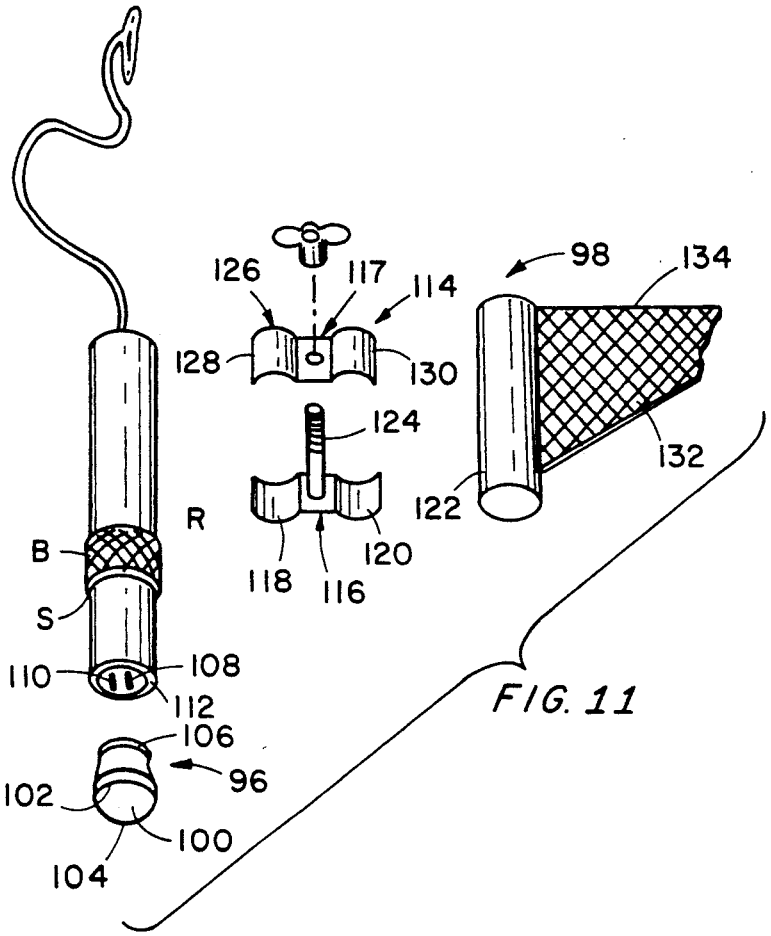
FIG. 11 illustrates an alternative form of the cane which includes a foot rest and tip located light as well as a locking ring.
Figure 12:
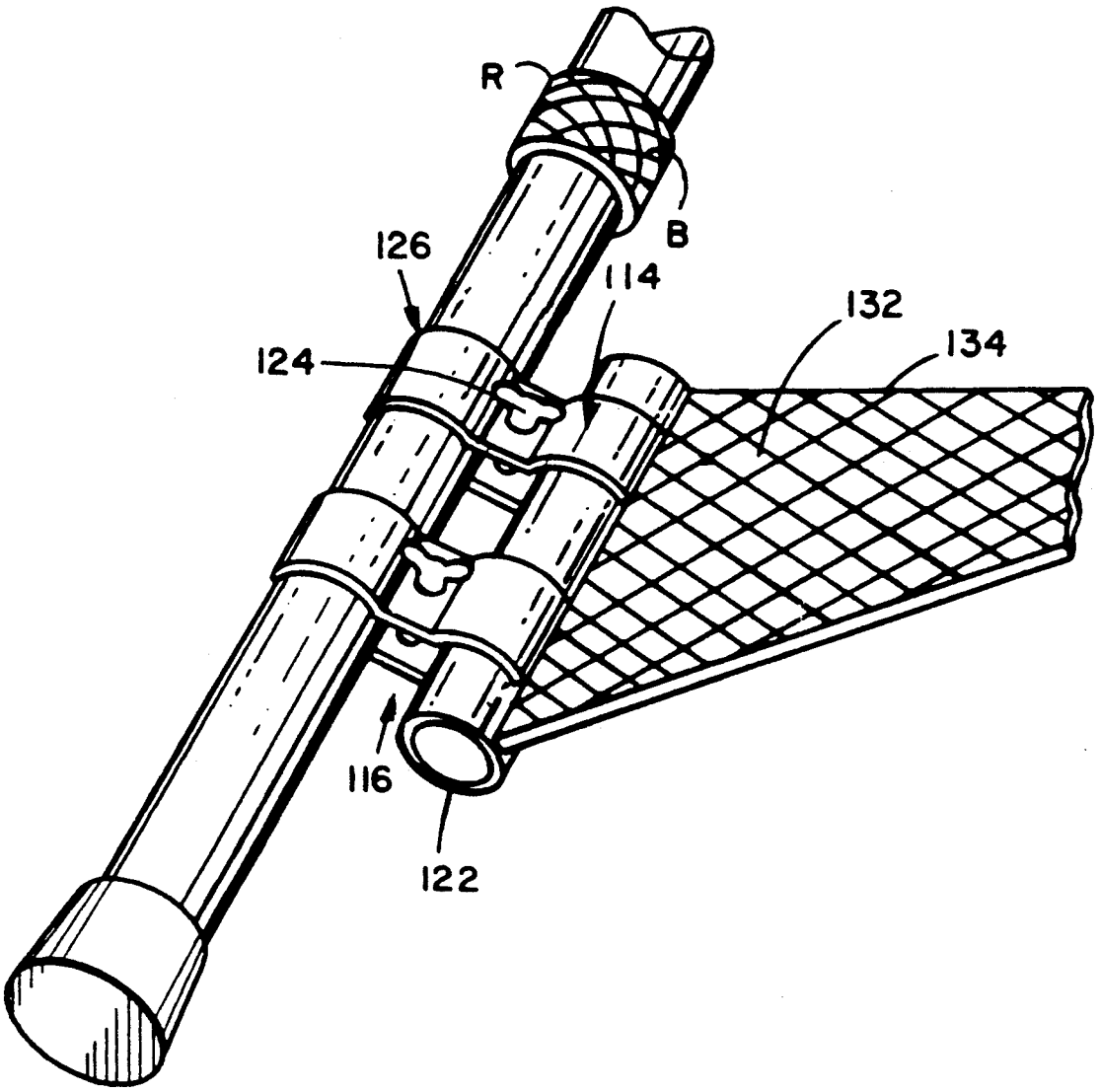
FIG. 12 illustrates the connection of the foot rest unit to the cane.

An alternative form of the device is shown in FIGS. 11 and 12 as including a surface-engaging tip mounted light generating unit 96 and a foot rest unit 98. The light generating unit 96 includes a light generating element, such as a light bulb 100 or the like, and a reflector 102 located in a casing 104. The unit 96 also includes a screw thread mount 106 having two plug-like prongs that are received in receptacle elements 108 and 110. The elements 108 and 110 are electrically connected to the leads 50 and 56 respectively so the light unit 96 is operated by the manual switch 24. A lock ring is shown and includes a tubular body B having a rear end R slidably mounted on the shaft portion section. An internal screw thread S cooperatively engages the screw thread of the light unit mount. When the rear end R engages the flared end 112, further threading of the lock ring onto the thread 106 pulls a flared end 112 toward the light unit while coupling the light unit to the shaft portion. The other lock rings mentioned above can work the same way.

The foot rest unit 98 includes a mounting unit 114 that comprises a butterfly clamp 116 that includes a first section 117 having a first wing 11B adapted to engage the shaft portion and a second wing 120 adapted to engage a mounting shaft 122. A screw fastener 124 is received through a second section 117 having first and second wings 128 and 130 that respectively co-operate with the first section wings 118 and 120 to clamp to the shaft portion and the mounting shaft. The foot rest portion includes an extended element 132 that is has a top surface 134 oriented horizontally when the foot rest is in place and the cane is resting on the surface-engaging tip.

It is understood that while certain forms of the present invention have been illustrated and described herein, it is not to be limited to the specific forms or arrangements of parts described and shown.

I claim:

1. A multi-purpose cane comprising:

A) a shaft portion that includes (1) a plurality of sections, including a first section having first and second ends, a second section having first and second ends, with said first section having a screw thread on said first section first end, and said second section having screw threads on said second section first end and on said second section second end, (2) first coupling means coupling said first section second end to said second section second end, and (3) a surface-engaging tip on said first section second end;

B) a hollow handle portion that includes (1) first and second ends, said handle second end being coupled to said shaft portion second section first end, (2) second coupling means releasably coupling said handle portion to said shaft portion, (3) a battery unit located inside said handle portion, said battery unit including a positive side and a negative side, (4) a first electrically conductive contact located inside said handle portion to be in electrical contact with one side of said battery unit and extending outwardly of said handle unit second end, (5) a second electrically conductive contact located inside said handle portion and spaced from said first electrically conductive contact and extending outwardly of said handle unit second end, and (6) a switch element mounted on said handle portion and including (i) a manually operated element that is slidably mounted on said handle portion to slide between an "on" position and an "off" position, (ii) a first electrically conductive element connected to said manually operated element and being in electrical contact with another side of said battery unit, and (iii) a second electrically conductive element connected to said manually operated element and being in electrical contact with said first electrically conductive element and being in electrical contact with said second electrically conductive contact when said manually operated element is in said "on" position, and being electrically insulated from said second electrically conductive contact when said manually operated element is in said "off" position;

C) a shaft-portion electrical circuit in said shaft portion and including (1) a first lead having one end thereof located adjacent to said shaft portion second section first end in position to be electrically engaged with said first electrically conductive contact element when said handle portion is engaged on said shaft portion, and having a second end, (2) a second lead having one end thereof located adjacent to said shaft portion second section first end in position to be electrically engaged with said second electrically conductive contact element when said handle portion is engaged on said shaft portion, and having a second end;

D) a light generating unit mounted on said shaft portion second section and including (1) a mounting shaft rotatably mounted on said shaft portion second section, (2) a first electrical contact slip ring mounted on said mounting shaft and being in electrical contact with said first shaft portion electrical circuit lead, (3) a second electrical contact slip ring mounted on said mounting shaft and being in electrical contact with said second shaft portion electrical circuit lead, (4) a light emitting element mounted on one end of said mounting shaft, (5) two electrical line conductors in said mounting shaft and each being connected at one end thereof to said light emitting element, one of said line conductors being connected to said first electrical contact slip ring and a second one of said line conductors being connected to said second electrical slip ring, (6) an electrically insulating case encasing said light emitting element, and (7) an electrically insulating knob attached to said mounting shaft for rotating said mounting shaft about its longitudinal axis;

E) a jack connection unit mounted on said shaft portion, said jack connection unit including electrical connection means electrically connecting said jack connection unit to said shaft portion electrical circuit;

F) a signaling unit having a jack connection unit engaging jack thereon; and

G) a battery unit recharging means having a jack connection unit engaging jack thereon.

2. The multi-purpose cane defined in claim 1 wherein said first and second coupling means each includes a tubular body having screw threads on an internal surface thereof, a rear end slidably connected to said shaft portion, and a flared end on said shaft portion that is engaged by said coupling means rear end.

3. The multi-purpose cane defined in claim 1 wherein said handle portion is arcuate.

4. The multi-purpose cane defined in claim 3 wherein said surface-engaging tip includes a light emitting element electrically connected to said shaft portion electrical circuit.

5. The multi-purpose cane defined in claim 4 wherein said surface-engaging tip portion light emitting element includes a reflector.

6. The multi-purpose cane defined in claim 5 wherein said surface engaging tip portion light emitting element includes a screw thread and said second lock ring includes a screw thread that threadably engages said tip portion screw thread.

7. The multi-purpose can defined in claim 6 further including a flared end on said shaft portion second section, said second lock ring engaging said flared end.

8. The multi-purpose cane defined in claim 3 further including a foot rest unit on said shaft portion.

9. The multi-purpose can defined in claim 8 wherein said foot rest unit includes a mounting unit for releasably attaching said foot rest unit to said shaft portion.

10. The multi-purpose cane defined in claim 9 wherein said foot rest unit includes a butterfly clamp having one portion engaging said shaft portion.

11. The multi-purpose cane defined in claim 10 wherein said foot rest unit further includes a mounting shaft engaging said butterfly clamp.

* * * * *